United States Patent [19]

Maxwell

[11] 4,242,150

[45] Dec. 30, 1980

[54] METHOD OF PRODUCING REINFORCING BARS WITH CORROSION RESISTANT COATING

[76] Inventor: Herris M. Maxwell, 2204 Riding Ridge Rd., Columbia, S.C. 29204

[21] Appl. No.: 42,443

[22] Filed: May 25, 1979

[51] Int. Cl.[3] ..... B21B 9/00

[52] U.S. Cl. ..... 148/6.3; 148/11.5 N; 148/12 B; 148/12.1; 72/47; 204/37 R; 427/360

[58] Field of Search ..... 204/37 R; 72/47; 228/235; 427/360; 148/11.5 N, 12 B, 12.1, 12 C, 127

[56] References Cited

U.S. PATENT DOCUMENTS

| | | | |
|---|---|---|---|
| 734,522 | 7/1903 | Edison | 204/37 R |
| 936,389 | 10/1909 | Wadsworth | 427/360 |
| 1,535,317 | 4/1925 | Koehnline et al. | 427/372 R |
| 1,574,131 | 2/1926 | Smith | 427/372 R |
| 2,037,733 | 4/1936 | Mudge | 148/127 |
| 2,731,403 | 1/1956 | Rubin | 204/37 R |
| 3,299,503 | 1/1967 | Freyberger et al. | 427/427 |
| 3,316,625 | 5/1967 | Flint et al. | 427/405 |

*Primary Examiner*—Ralph S. Kendall

*Attorney, Agent, or Firm*—Richards, Shefte & Pinckney

[57] ABSTRACT

A method of forming steel reinforcing bars and other bar mill products with a protective coating of nickel to enhance the corrosion resistant characteristics of such bars, such method comprising the steps of forming an elongated steel billet with a generally rectangular cross-section, then electroplating a thin layer of nickel onto said steel billet, painting the exterior surface of said plated steel billet with a slurry consisting essentially of water and a refractory mortar, arranging a plurality of such steel billets in contiguous relationship in a furnace and heating them to a temperature at which they become malleable (approximately 2150°-2350° F.), then hot rolling the steel billets to form them into elongated generally round bars. The resulting bars have a lightly adhering nickel oxide film at the surface of the bar; an outer layer of wrought nickel; an intermediate nickel-iron layer metallurgically bonded to the nickel and the steel core; and, a nickel containing ferrous substrate on the outer peripheral surface of the steel core. The refractory mortar coating is usually removed from the billets, prior to the rolling thereof, by suitable descaling equipment.

9 Claims, No Drawings

METHOD OF PRODUCING REINFORCING BARS WITH CORROSION RESISTANT COATING

BACKGROUND OF THE INVENTION

The corrosion and deterioration of reinforcing steel in concrete which is exposed to ambient conditions promoting oxidation is a well-known problem in structural fields, and the problem becomes even more acute when the steel is exposed to chloride conditions that tend to promote oxidation to an adnormal extent, as, for example, when the steel is exposed to deicing salt, coastal atmospheric conditions, tidal wetting or flowing sea water. Thus, it is common for steel reinforcing bars used in structural concrete to be exposed to one or more of the foregoing adverse conditions, and spalling and delamenation of structural concrete resulting from the corrosion of the reinforcing steel is the major cause of deterioration of concrete structures subjected to deicing salts (e.g. highway bridge structures) or to marine environment chlorides (e.g. structures having structural concrete pillars located at least partially submerged in salt water).

In an effort to inhibit the corrosion of steel by oxidation, efforts have been made to apply a suitable protective coating to steel members which serves to prevent direct contact between the steel and the corrosion producing elements. For example, it is common practice to galvanize steel to increase its service life, and while galvanized steel has the advantage of being relatively inexpensive and providing generally satisfactory results under normal ambient conditions, it has been found that galvanized steel has a relatively rapid rate of oxidation when the steel is situated in a structural concrete environment so that it is generally unsatisfactory for uses of this sort.

Because of the generally unsatisfactory results obtained from galvanized steel used in structural concrete, some steel producers have applied an epoxy coating to steel reinforcing members. However, epoxy coatings are relatively expensive, and, perhaps more importantly, they are somewhat brittle and therefore subject to damage as a result of the normal wear and tear that is inherent in shipping and placing the epoxy coated reinforcing members in construction projects. When the relatively thin epoxy coating becomes cracked or pierced during shipping or handling, the steel core is exposed to galvanic corrosion which tends to spread rapidly beneath the epoxy coating.

The benefits of applying a protective coating of a corrosion-resistant metal, such as nickel, to a steel core are also well-known, but difficulties have been encountered in devising a method of applying nickel coatings to steel which is economically feasible and which is commercially practical in the sense that it can be utilized in conventional carbon steel bar mill operations using equipment already available.

At the present time, there are four principal methods used in the steel industry to coat steel with corrosion resistant metals such as nickel. One involves the conventional and well-known process of simply electrodepositing the plating nickel onto a steel base metal, such plating process resulting in the steel having a dentritic exterior surface formation which is less corrosion resistant than a wrought nickel formation typical of rolled or forged nickel. Secondly, it is known to cast molten nickel about a steel billet arranged in a mold, as disclosed, for example in Mudge U.S. Pat. No. 2,037,732. Another method involves the utilization of nickel in a vehicle which is applied to the steel, as by spraying, then heat treating the sprayed steel to drive off the vehicle, after which the steel is cold rolled, all as disclosed, for example, in Wesley U.S. Pat. No. 2,289,614, Freybergen U.S. Pat. No. 3,299,503 and Flint U.S. Pat. No. 3,316,625. Finally, a known plating process includes the steps of welding a nickel sheet to a steel plate, and then bonding the two metals using pressure rolls to reduce the thickness of the sandwiched metals.

Experimental work was conducted sometime ago on a relatively small scale to produce nickel coated steel reinforcing members, and while the end product resulting from such experimental work was found to be satisfactory, the method was not commercialized because it was not believed to be commercially feasible in carbon steel bar mill operations.

In the foregoing experimental work, a conventional steel billet having a generally rectangular cross-section was coated with a layer of nickel using conventional electroplating techniques, and the plated steel billet was then hot rolled to its final round shape. The resulting bar was coated with nickel, and had a wrought exterior surface that was preferable to the dentritic surface resulting from simply electroplating the nickel coating on the bar. Moreover, the hot rolling of the billet after it had been plated with nickel sometimes resulted in the formation of a nickel-iron alloy interface between the exterior nickel surface and the steel core, but it is not believed that the beneficial protective characteristics of this interface was recognized. One of the drawbacks of the resulting nickel coated bar was that the thickness of the wrought nickel surface layer was not entirely uniform, probably because the billet was square at the time the electroplating of the nickel was done, and subsequent hot rolling of the billet into a round shape did not uniformly distribute the nickel about the steel during rolling due to differential oxidation of the plated surface during the reheating.

Moreover, the foregoing experimental work was done on a small scale which did not take into consideration the practical aspects of commercially using the plating method in existing bar mill operations. For example, nickel is quite expensive and it is known that when nickel is exposed to oxygen at the high temperature required for hot rolling, significant quantities of nickel are passed off and lost through gas diffusion. This condition is conventionally corrected or alleviated by heating a nickel coated billet in equipment which provides a reducing atmosphere having little or no oxygen, but such equipment is relatively expensive and is not normally found in carbon steel bar mill operations. Additionally, when the nickel plated billets are heated to the above-mentioned high temperature, the nickel plating becomes somewhat soft and tacky, and if such billets are located closely adjacent to one another they tend to become welded to one another. While this problem is not too severe in small scale experimental work where the individual plated steel billets are heated separately or at least in spaced relation to one another, the economic considerations in a commercial operation dictate that a large number of billets be heated simultaneously in as small an area as possible (e.g. with the billets in abutment) to raise the production capacity of the process to an economically feasible level, and, in this regard, conventional steel billet furnaces presently found in carbon steel bar mill operations are designed to hold a large number of billets in close, abutting relation during heating.

In accordance with the present invention, a unique method of producing hot rolled nickel coated steel bars is provided which overcomes the draw backs of the prior art discussed above, and which provides a relatively inexpensive process for use in carbon steel bar mill operations using generally available conventional equipment in a commercially practiced operation.

SUMMARY OF THE INVENTION

The present invention provides a unique method of applying a protective metal coating, such as nickel, to a metal or ferrous billet to enhance the corrosion resistant characteristics of the rolled product. This method includes the steps of first plating the exterior surface of the steel billet with a relatively thin layer of a protective metal such as nickel, and then covering the exterior surface of the plated billet with an adherent layer of a suitable refractory material. The billet is then heated in a conventional furnace to a temperature at which the billet is malleable, and then hot rolled to reduce the thickness thereof whereby the product is formed with a final coating of the nickel metal having a plurality of protective layers. The refractory coating is preferably separated from the billet, prior to the hot rolling thereof, by any conventional mechanical descaling equipment.

Preferably, the refractory material is a refractory mortar in the form of powder or paste, and is mixed with water to form a slurry which can be easily applied to the billet by brushing or spraying or other suitable means.

Because the plated billet is entirely covered with a cacoon of the refractory material prior to being heated, a number of such billets can be simultaneously carried through a conventional hearth pusher furnace in abutting relationship so as to increase the production capability of the process, and the protective refractory material covering about each billet prevents welding at the abutting surface of the adjacent billets while preventing significant loss, through oxidation, of the relatively expensive nickel plating even when the billet is heated for long periods of time in a furnace having a neutral or uncontrolled atmosphere.

A bar formed by the method of the present invention has significant corrosive resistant properties, and this method reduces substantially the costs involved in hot rolling a corrosive resistant bar without requiring any special equipment other than that normally available for carbon steel bar mill operations.

DETAILED DESCRIPTION OF THE PREFERRED EMBODIMENT

The following description sets forth a specific illustration of the method of the present invention which has been carried out with successful results. However, it is to be expressly understood that the particular details of the following description, such as specific dimensions and the like, are only exemplary and may be varied to meet the demands of any particular practice of the present invention. Also, while the following description is directed to the forming of reinforcing bars, the method of the present invention could also be used in forming other carbon steel bar mill products, such as angles and rods.

In the preferred embodiment of the present invention, steel or ferrous billets are formed by any conventional process, such as a continuous casting process or forming the billet from an ingot by rolling, with each billet being formed with a predetermined length (e.g. ten to twelve feet) and with a rectangular cross-section (e.g. 4½ inches-by-4½ inches). The particular dimensions of the billet are selected to provide a desired exterior surface having a predetermined ratio with the thickness of the final coating formed on the bar.

The entire exterior surface of each billet is then plated with a layer of protective metal, such as nickel, by any conventional plating process, preferably dull Watts electroplating, such layer having a thickness of about 28 mils, depending on the final product coating specified. It should be noted here that the protective nickel is a relatively expensive metal, and careful consideration must be given to all factors which might result in undue losses of this metal during the forming process, as will be discussed in greater detail below.

The nickel plated billets are then individually covered with an adherent layer of a refractory material that will withstand high furnace temepratures, generally up to approximately 2350 degrees F. A refractory material found to be particularly suitable for use in the present invention is a brick fire mortar composed of the following ingredients:

Silica, 82 to 87% by weight
Aluminum, 3 to 6% by weight
Ferrous Oxide, 0.3 to 0.4% by weight
Calcium Oxide, 0.05 to 0.1% by weight
Magnesium Oxide, 0.05 to 0.1% by weight
Titanium Oxide, 0.5 to 1.5% by weight
Potassium Sodium Oxide, 2.3 to 2.8% by weight Before being applied to the billets, the aforesaid refractory composition is preferably mixed with water at a ratio of about one part water to five parts refractory material (by volume) to form a slurry, and this slurry is then applied directly to all surfaces of the billet by any convenient method such as spraying, brushing or rolling, until the refractory material has a thickness of about 1/16-inch to 3/16-inch. The aforesaid refractory material is well suited to use in the method of the present invention because it has a low volume loss (e.g. 5 to 6%) during heating of the billet at furnace temperatures up to 2350 degrees F., and it is reasonably fast setting while also having adherence capabilities which assures that the integrity of the refractory covering is sustained during the movement of the billets through the furnaces as will be described presently. It is to be understood, also, that refractory materials other than the particular composition set forth above could be used in the present invention, provided that such refractory material protect the billet and plating during heating as will be described below. Further addition of charcoal granules may be added to provide a degree of local reducing carbon monoxide gas during part of heating cycle to further limit oxidation along with the hydrogen released from the slurry compound.

After the plated bars have a refractory covering applied to the exterior surfaces thereof, they are heated in conventional hearth-pusher type furnace which is fired at both its top and bottom with zone heat control designed for three separate zones, namely a preheat zone having a preferred temperature of about 1600 degrees F., a soak zone having a preferred temperature of about 1800 degrees F. to 2000 degrees F., and a final heat zone having a preferred temperature of 2000 degrees F. to 2350 degrees F. The billets are continuously pushed through the furnace on water cooled rails in the first two furnace zones and on the bottom of the furnace in the last zone. To facilitate the pushing of the billets through the furnace, they are arranged with their lengthwise axes in parallel relation, and with each billet in direct contact or abutting relationship with the two adjacent billets on each side whereby when the billets at the leading or entry end of the furnace is pushed in a direction transversely to the lengthwise extent of the abutting line or billet, the entire line is moved serially through the furnace. Thus, a continuous heating process is established by constantly adding new billets at the entry end of furnace and taking off fully heated billets at the exit end of furnace after the billets have been pushed through all of the aforementioned stages of the furnace. Preferably, the cycle time for any billet moving through the furnace is approximately one hour, and when the billet is removed to a point that it is malleable. The cycle time of one hour, while generally desirable, may be varied substantially (e.g. extended to two hours) if desired. The degree of diffusion is primarily achieved in the 2000 to 2300 degrees F. zone at a rate approximately 10% per mil per half hour.

The malleable billet is then hot rolled, using conventional rolling equipment, to reduce the thickness of the billet, and preferably to change its shape from one having a rectangular cross-section of the aforesaid 4½ inches-by-4½ inches dimensions to a bar having a typical circular cross-section with a diameter of about ⅝ inch. During this rolling process, the nickel plating is distributed generally uniformly about the cylindrical exterior surface of the product and forms a protection layer of wrought nickel approximately one to two mils in thickness. Additionally, an iron-nickel alloy interface approximately 0.1 to 0.2 mils. in thickness is formed between the ferrous core and the nickel to improve substantially the corrosion resistant characteristics of the finished bar. Normal handling of the billet, after it has been heated, will cause some, if not all of the refractory material to be separated from the billet, but conventional descaling equipment may be used, if necessary or desirable, to remove mechanically any lingering refractory material from the billets prior to the rolling thereof.

By covering the plated billets with a coating of refractory material in accordance with the present invention, a number of practical advantages are obtained. For example, substantial savings are realized with regard to the loss of expensive nickel during the heating of the billets without requiring the steel bar mill operator to add expensive equipment, such as a reduced atmosphere furnace which is normally not found in most steel bar mill operations. As mentioned above, the nickel plating is quite expensive, and during heating of the nickel plated billets in a conventional furnace, a substantial quantity of the nickel would be lost through oxidation, particularly when the nickel plated billet is required to be maintained in the furnace for an extended period of time to provide for adequate heating of the billet preparatory to its being hot rolled. However, the coating or refractory material at the exposed surfaces of the nickel plated billet substantially reduces the loss of nickel by oxidation while the billets are in the furnace, even though the furnace is not a reduced atmosphere furnace. Additionally, the aforementioned oxidation of the nickel plating causes such plating to become so embrittled as to destroy its integrity as a protective cladding, and the refracting material coating, by reducing such oxidation, serve to improve the protective characteristics of the nickel in the finished bar.

Additionally, the refractory material coating eliminates any tendency of the nickel plating on adjacent billets to become welded as the nickel become soft and tacky under the influence of heat (e.g. at 1800 degrees F. to 2400 degrees F.). Thus, the refractory coating permits the billets to be positioned in immediately adjacent relationship in the furnace without requiring the placement of spacers therebetween, and the billets can be serially pushed through the furnace during heating as discussed above without the billets becoming welded. Additionally, without protection of the refractory material coating, the billet plating will be reduced to a greater extent on the sides exposed to flame impingement within the furnace and to a lesser extent on the mating faces resulting in non-uniform coating thickness even to the extent that one side of the product may be acceptable and the other side will have little or no coating.

The aforesaid nickel oxide surface film produced by the method of the present invention is uniquely capable of maintaining passivation and bonding, and provides initial protection for an extended period of time under most conditions.

The aforesaid outer layer of wrought nickel achieved by this method provides a metalic barrier coating 1 to 3 mils thick which, when protected from erosion by the concrete, is virtually immune to corrosion from chloride contamination, thereby protecting the steel core. Unlike zinc, nickel is not anodic to steel and does not produce a harmful corrosion product.

The aforesaid nickel iron alloy, while only 1/10 to 2/10 mil in thickness, is a material superior to pure nickel in resistance to chloride corrosion. The aforesaid substrate, containing only a small percent of nickel (e.g. as little as 1% being adequate) and being 1 to 3 mils deep, is an inert product available to stop cell corrosion in any pin holes that may exist and to prevent under film corrosion.

A unique feature of the refractory protection coating system of the present invention is the method employed to protect the billet from excessive oxidation during heating while permitting sufficient oxidation (1) to develop the surface nickel oxide film; (2) to transform the dentritic nickel into wrought nickel; (3) to maintain the temperature sufficiently high for a sufficient period of time for sufficient iron ions to diffuse into the nickel to improve the resistance of the nickel to chloride corrosion; and (4) to hold the temperature at a sufficiently high level to permit the nickel to diffuse into the steel to improve the steel substrate resistance to corrosion.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A method of applying a protective metal coating to a metal billet to produce a bar having corrosive resistant characteristics, such method comprising the steps of:

(a) plating the entire exterior surface of a ferrous billet with a layer of non-ferrous protective metal;

(b) covering the entire exterior surface of said plated ferrous billet with an adherent layer of a refractory material;

(c) heating said plated and covered ferrous billet in a normal atmosphere furnace to an elevated temperature at which said billet is malleable and at which significant oxidation of said non-ferrous protective metal would normally occur, said oxidation being substantially reduced by the presence of said layer of refractory material; and (d) hot rolling said malleable ferrous billet to reduce the thickness thereof, whereby said ferrous bar is formed with a final coating including an exterior layer of said non-ferrous protective metal.

2. A method of applying a protective metal coating to a metal billet as defined in claim 1 and further characterized in that at least part of said layer of refractory material is removed from said ferrous billet after said heating thereof and prior to said rolling thereof.

3. A method of applying a protective metal coating to a metal billet as defined in claim 1 and further characterized in that said refractory material includes a refractory mortar in powder form mixed with water to form a slurry, and in that said slurry is applied to the exterior surface of said plated ferrous billet.

4. A method of applying a protective metal coating to a metal billet as defined in claim 3 and further characterized in that said refractory material includes charcoal granules to generate a carbon monoxide reducing gas at the surface of the billet during said heating thereof.

5. A method of applying a protective metal coating to a metal billet as defined in claim 1 and further characterized in that said protective metal is nickel, and that said plated and covered billets are heated by passing a plurality of billets serially through said normal atmosphere furnace by arranging said billets in lengthwise parallel relationships and in abutment with one another during such passage through said furnace.

6. A method of applying a protective metal coating to a metal billet as defined in claim 1 and further characterized in that said ferrous billet is formed of steel, and in that said protective metal coating is nickel.

7. A method of applying a protective metal coating to metal billets to produce a bar having corrosion resistant characteristics, said method comprising the steps of:

(a) forming a plurality of elongated steel billets each having a generally rectangular cross-section;

(b) electro-depositing a plating of nickel on the exterior surface of each of said steel billets;

(c) covering the exterior surface of each said plated steel billet with an adherent layer of refractory mortar in the form of a slurry;

(d) arranging said plurality of plated and covered steel billets in lengthwise contiguous relationship, and heating said steel billets in a normal atmosphere furnace to an elevated temperature at which said billets are malleable and at which significant oxidation of said nickel would normally occur, said oxidation being substantially reduced by the presence of said layer of refractory material; and (e) hot rolling said malleable steel billets to form them into a shape having a generally circular cross-section whereby elongated circular steel bars are formed with an exterior coating of nickel and an intermediate layer of nickel-iron alloy.

8. A method of applying a protective metal coating to metal billets as defined in claim 7 and further characterized by the step of mechanically removing said refractory mortar from said steel billets after said heating thereof and prior to said rolling thereof.

9. A method of applying a protective metal coating to metal billets as defined in claim 7 and further characterized in that said contiguous steel billets are pushed serially through said normal atmosphere furnace to obtain said heating thereof.

* * * * *

UNITED STATES PATENT OFFICE

CERTIFICATE OF CORRECTION

Patent No. 4,242,150 Dated Dec. 30, 1980

Inventor(s) Herris M. Maxwell

It is certified that error appears in the above-identified patent and that said Letters Patent are hereby corrected as shown below:

Column 5, line 19, after "removed" insert --from the furnace the temperature of the billet has been raised--.

Signed and Sealed this

*Thirteenth* Day of *October 1981*

[SEAL]

*Attest:*

GERALD J. MOSSINGHOFF

*Attesting Officer*

*Commissioner of Patents and Trademarks*